United States Patent [19]

Strom-Olsen et al.

[11] Patent Number: 5,015,992

[45] Date of Patent: May 14, 1991

[54] COBALT-NIOBIUM AMORPHOUS FERROMAGNETIC ALLOYS

[75] Inventors: John O. Strom-Olsen, Montreal; Piotr Z. Rudkowski, Pierrfonds, both of Canada

[73] Assignee: Pitney Bowes Inc., Stamford, Conn.

[21] Appl. No.: 372,991

[22] Filed: Jun. 29, 1989

[51] Int. Cl.[5] ..... G08B 13/24

[52] U.S. Cl. ..... 340/551; 148/313; 340/572

[58] Field of Search ..... 340/572, 551; 164/463; 148/336, 425–426, 312–313

[56] References Cited

U.S. PATENT DOCUMENTS

| | | | |
|---|---|---|---|
| Re. 32,428 | 5/1987 | Gregor et al. | 340/572 |
| 4,257,830 | 3/1981 | Tsuya et al. | 148/112 |
| 4,527,614 | 7/1985 | Masumoto et al. | 164/463 |
| 4,553,136 | 11/1985 | Anderson et al. | 340/572 |
| 4,710,754 | 12/1987 | Montean | 340/572 |
| 4,743,890 | 5/1988 | Hilzinger et al. | 340/551 |
| 4,745,401 | 5/1988 | Montean | 340/572 |
| 4,823,113 | 4/1989 | Hasegawa | 340/551 |

OTHER PUBLICATIONS

New Fe-Based Soft Magnetic Alloys Composed of Ultrafine Grain Structure, by Y. Yoshizawa et al., Journal of Applied Physics 64, Nov. 15, 1988.

*Primary Examiner*—Glen R. Swann, III
*Assistant Examiner*—Thomas J. Mullen, Jr.
*Attorney, Agent, or Firm*—Peter Vrahotes; Melvin J. Scolnick; David E. Pitchenik

[57] ABSTRACT

Amorphous ferromagnetic alloys having a niobium content in the range of 2.5 to 15 atomic percent have been conceived. These alloys are obtained directly in the amorphous state or as a mixture of amorphous and crystalline places. These alloys have superior properties relative to prior known amorphous and some amorphous alloys. The amorphous ferromagnetic alloys of this invention are readily produced by rapid solidification techniques with no need for subsequent treatment.

25 Claims, 2 Drawing Sheets

COBALT-NIOBIUM AMORPHOUS FERROMAGNETIC ALLOYS

RELATED APPLICATIONS

Attention is directed to co-pending patent applications having similar subject matter entitled Electromagnetic Metal Fibers Having Use In Electronic Article Surveillance Markers And Method Of Making Same, U.S. Ser. No. 290,547 and filed Dec. 27, 1988 and Ferromagnetic Alloys With High Nickel Content And High Permeability filed concurrently herewith.

BACKGROUND OF THE INVENTION

Amorphous ferromagnetic alloys are well known and have had wide use throughout industry. One area where amorphous ferromagnetic alloys are receiving particular attention is in the field of electronic article surveillance (EAS) as disclosed by Picard in French Pat. No. 763,681 (1934). Generally, certain amorphous ferromagnetic alloys exhibit high magnetic permeability and low coercivity thereby making their use as an EAS marker attractive. In the prior art, it was suggested to use ferromagnetic strips or wires sandwiched between two attached layers of dielectric material to form markers that can be detected in a magnetic field as described in U.S. Pat. Nos. 4,581,524 and 4,568,921, respectively. U.S. Pat. No. 3,856,513 describes varoius amorphous ferromagnetic alloys and methods for making the same. Although prior amorphous ferromagnetic alloys have worked well, it would be advantageous to have amorphous ferromagnetic alloys that have properties that lend themselves to use in an EAS marker and are easy to fabricate, while being less expensive. the reason for the relatively high cost of prior amorphous ferromagnetic alloys having desired properties was occasioned by the need to include a high content of boron in their compositions, usually between 7 and 20%. Boron is an expensive material and generally is the most expensive ingredient in prior amorphous ferromagnetic materials.

SUMMARY OF THE INVENTION

Novel compositions of amorphous ferromagnetic alloys have been conceived having a high cobalt-niobium content with a reduced presence of boron in such alloys. These amorphous ferromagnetic alloys contain between approximately 2.5 and 15 atomic weight percent niobium, 65 and 75% cobalt, less than 15% boron and various percentages of iron and silicon.

The niobium containing amorphous ferromagnetic alloys of the instant invention exhibit high magnetic permeability and low coercivity. In addition, these alloys have high electrical resistivity, are high corrosion resistance, ability to withstand degradation of performance under repeated mechanical stressing and are simple to fabricate and require no treatment after manufacture and before incorporation into an EAS marker.

A primary advantage of the amorphous ferromagnetic alloys of the instant invention is that these alloys contain appreciably less boron than prior amorphous ferromagnetic alloys. Boron is an expensive component of prior amorphous ferromagnetic alloys and its percentage reduction is for this reason beneficial.

DETAILED DESCRIPTION OF THE PREFERRED EMBODIMENT

Reducing the content of boron in an amorphous ferromagnetic alloy leads to the advantage of lower cost. Alloys have been found which exhibit high magnetic permeability although having reduced quantities of boron in their composition. These amorphous ferromagnetic alloys have the following general formula:

$$Co_aFe_bNb_cSi_dB_e$$

where $100>a+b+c+d+e>99\%$ and whose individual values lie in the following ranges:

| | | |
|---|---|---|
| a = 65% to 79% | | |
| b = 2 to 7% | | |
| c = 2.5% to 15% | | |
| d = less than 24% inclusive | | |
| e = less than 12% inclusive and | | |
| and | $0 \leqq d + e \leqq 14$ | when $0 \leqq d \leqq 4$ |
| | $0 \leqq e \leqq 10$ | when $4 \leqq d \leqq 5$ |
| | $0 \leqq e \leqq 10$ or | when $5 \leqq d \leqq 7$ |
| | $e \leqq 12$ and $d + e \leqq 17$ | when $5 \leqq d \leqq 7$ |
| | $0 \leqq e \leqq 12$ | when $7 \leqq d \leqq 8$ |
| | $0 \leqq d + e \leqq 20$ | when $8 \leqq d \leqq 12$ |
| | $0 \leqq e \leqq 8$ | when $12 \leqq d \leqq 15$ |
| | $0 \leqq d + e \leqq 23$ | when $15 \leqq d \leqq 18$ |
| | $0 \leqq e \leqq 5$ | when $18 \leqq d \leqq 20$ |

All of the above percentages are in atomic percent as well as throughout the balance of this specification including the claims.

Levels of purity are those found in normal commercial practice. All alloys were fabricated by rapid solidification at cooling rates of between 1 and $2\times10^6 Ks^{-1}$. The alloys are amorphous or a mixture of amorphous and less than 50% crystalline phases.

Specific examples of amorphous ferromagnetic alloys are given in the following table:

TABLE II

| | Co | Fe | Nb | Si | B | % Amorphous |
|---|---|---|---|---|---|---|
| I | 71 | 4 | 2.5 | 16 | 6.5 | >70 |
| II | 71.5 | 4 | 3.5 | 16.5 | 4.5 | >70 |
| III | 71 | 4 | 4 | 16 | 5 | >70 |
| IV | 71 | 4 | 9 | 14 | 2 | >70 |
| V | 71 | 4 | 9 | 13 | 3 | >70 |

The percent of material in the amorphous phase has been estimated from X-ray diffraction measurement and enthalpy of crystallization.

The advantages of this niobium-cobalt amorphous ferromagnetic alloys over prior alloys are:

(1) Enhanced magnetic performance: at 6 kHz the differential magnetic permeability at the coercive field for some if the cobalt-niobium amorphous ferromagnetic alloys of the instant invention is up to 50% greater than prior amorphous ferromagnetic alloys.

(2) Low boron concentration: the boron content is below the level of prior amorphous and partially amorphous ferromagnetic alloys, the boron content of the instant alloy being as low as 2%. Boron is the most expensive component of prior amorphous ferromagnetic alloys and its percentage reduction is obviously beneficial. It is believed that the reduction of the boron content and the inclusion of niobium, a microstructure with small crystallites in the amorphous matrix is formed that results in enhanced magnetic properties.

In other characteristics, the instant amorphous ferromagnetic alloys are at least equal to prior amorphous ferromagnetic alloys.

Figure 7:
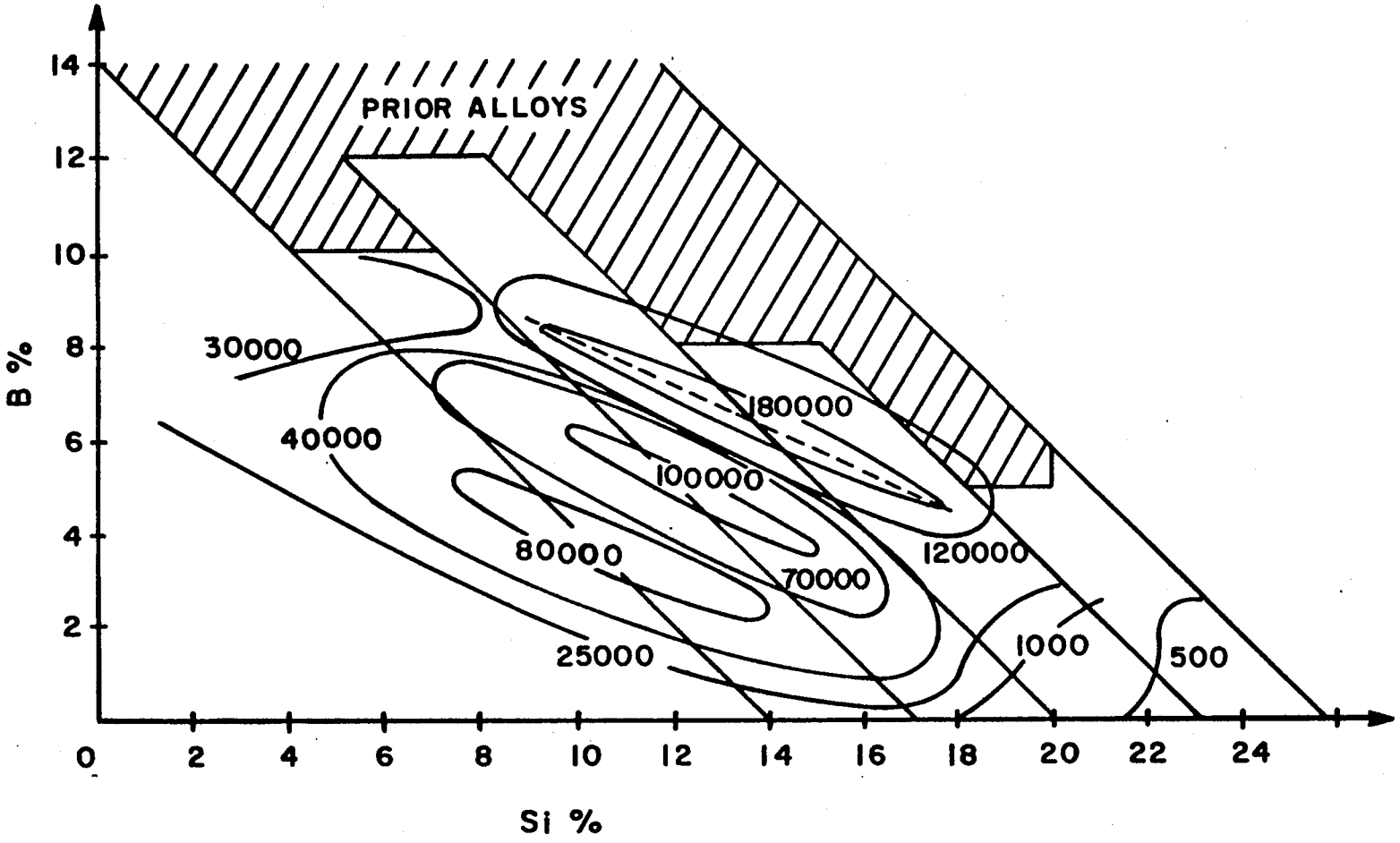
FIG. 7 is a plot showing contours of equal differential magnetic permeability as a function of the composition of amorphous ferromagnetic alloys.

FIG. 7 displays the permeability in a magnetic field of 6 kHz of the alloy series $Co_{71}Fe_4Nb_{25-x-y}Si_xB_y$, the shaded portion representing the range composition of prior alloys. The numbers associated with the curved lines represent the value of permeability with the highest permeability shown dotted, i.e. 180,000.

When prepared by rapid solidification, cooling rate greater than $5\times10^5$ ° K. $s^{-1}$, the material can be used in any of the following forms: ribbons, foil, flakes, wires and fibers. A major advantage of the alloys of the instant invention can be used in EAS application as cast All alloy compositions included in the above tables can be fabricated by the rapid solidification process (melt extraction) in the form of fine fibers i.e., a diameter of less than 80 μm. The amorphous, as well as partially amorphous samples of the alloys were all ductile in the as quenched condition. The density of the instant alloys was found to be about 8 g/cm$^3$.

Figure 1:
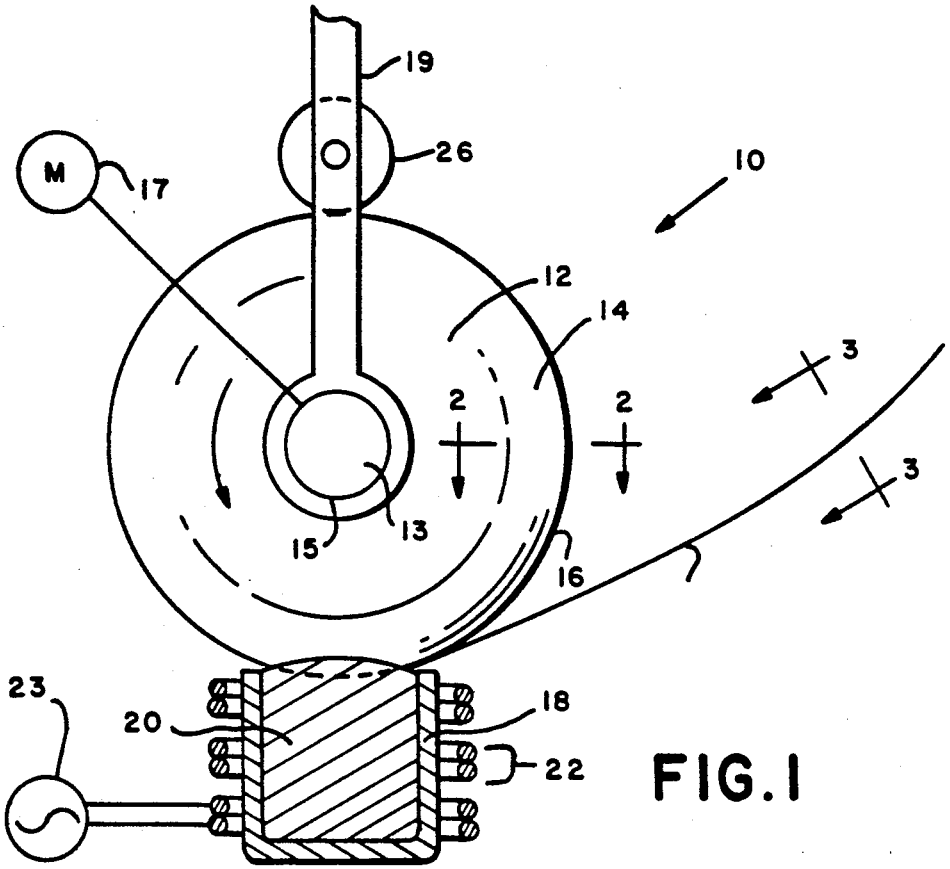
FIG. 1 is a longitudinal cross sectional view of a melt extraction device for producing amorphous ferromagnetic alloys in accordance with the instant invention.
Figure 2:
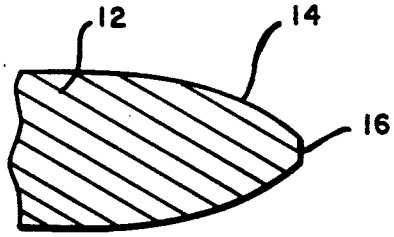
FIG. 2 is an enlarged, cross sectional view taken along the lines 2—2 of FIG. 1 and showing details of the perimeter of the spinning disk shown in FIG. 1.
Figure 3:
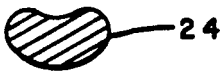
FIG. 3 is a cross sectional view taken along the lines 3—3 of FIG. 1 showing the cross section a fiber produced by the device of FIG. 1.

Referring initially to FIGS. 1-3, a rotating-wheel device capable of producing rapid solidification is shown generally at 10 that produces amorphous ferromagnetic fibers in accordance with the principles of the instant invention. What is shown and will be described is a melt extraction technique, but it will be appreciated that other techniques can be used in practicing the invention including melt spinning, melt drag and pendent drop method. Additionally, the fibers and ribbon of the instant invention can be molded in plastics, rubber and resins and can be cast in low temperature metal molds without deteriorating the magnetic properties.

Figure 4:
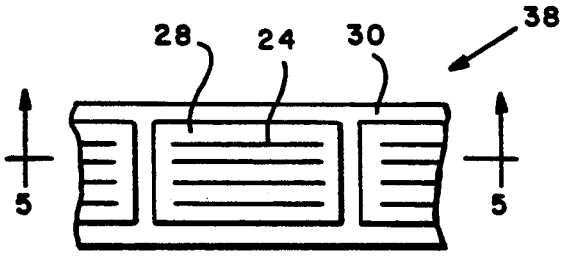
FIG. 4 is a plan view of a composite web including fibers made by the device shown in FIG. 1.
Figure 5:
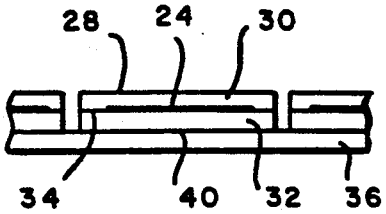
FIG. 5 is a cross sectional view taken along the lines 5—5 of FIG. 4 showing a side elevational view of the composite web.

The spinning device 10 includes a disk 12, or wheel, which is fixedly supported by a rotatable shaft 13 which is mounted on a movable arm 19. The disk 12 has a reduced section 14 at its perimeter which has an edge 16 that can vary in thickness depending upon whether fiber or ribbon is to be spun. The disk 12 used in the reduction to practice of the invention had a diameter of six inches and the edge 16 had a radius of curvature of approximately 30 microns, but 5 to 50 microns would be acceptable for the production of fibers. Where ribbon is to be spun, the edge 76 would be thickened substantially depending on the width of ribbon to be produced. The shaft 13 is in engagement with a motor 17 by any convenient means so that the shaft, and the disk 12 that is mounted thereon, can be rotated. A cup shaped tundish 18 is disposed below the disk 12 and is adapted to receive a metal alloy composition 20. Induction coils 22 are disposed around the tundish 18 and are connected to a source of power 23. Upon sufficient power being applied to the coils 22, the metal alloy composition 20 within the tundish 18 will become molten. The disk 12 is rotated as indicated by the arrow in FIG. 1 and upon the disk rotating within the molten alloy composition, it will produce a fiber 24 which can be cut to any desired length. Optionally, in contact with the flange is a wiper 26 made of a material such as cloth for the purpose of keeping the reduced section 14 clean. Referring now to FIGS. 4 and 5, the fibers 24 are aligned relative to one another and located between upper and lower sheets 30,32 respectfully, that are joined by an adhesive 34 to form a marker which is shown in the form of a label 28. The labels 28 are supported by a web 36 and can be applied to the surface of an article through use of a labeller as is known in the art. As used in this disclosure, the term label is intended to include tickets and tags as well. Reference can be had to U.S. Pat. No. 4,207,131 for details of a carrier web described herein. Preferably, the marker 28 has a length of less than one inch and preferably about ⅝". With such a size, the composite web 38 can be used in a commercial labeler such as an 1110 labeler available from Monarch Marking Systems Inc., Dayton, Ohio. Although the marker 28 is shown with upper and lower sheets, 30,32, it will be appreciated that the fibers 24 can be adhered to the lower sheet 32 only and the upper sheet can be eliminated.

The source of power 23 is enabled so as to cause the induction coils to heat the ferromagnetic alloy 20 above its melting point thereby creating a molten bath of ferromagnetic alloy. As will be noted, the reduced section 14 of the disk 12 extends into the metal 20. Although the metal is shown having a dome appearance thereon, this is slightly exaggerated for purposes of showing the reduced section 14 being received within the melt. In any case, a portion of the diameter of the disk 12 will extend below the upper most portions of the tundish to engage the ferromagnetic alloy 20 after it has reached its melting temperature. Depending upon the temperature of the alloy, the arm 19 will be lowered so as to place the reduced section 14 within the metal alloy and the motor 17 will be enabled thereby rotating the disk 12. The disk 12 will be rotated in the direction as shown by the arrow in FIG. 1 and a fiber of ferromagnetic metal 24 will be formed thereby. This fiber 24 can be as long as is required.

It will be appreciated that the rapid solidification process described will produce a fiber or ribbon that is in ready to use condition i.e., it goes from the molten state directly to the solid state in a state for immediate use. No subsequent treatment is required to achieve the properties sought.

Under optimum conditions, the fiber 24 could be of indefinite length, but it has been found that certain conditions affect the length of the fiber. The conditions that cause variation in the length of the fiber are rotational velocity of the disk 12, vibrations in the system and shape and design of the disk and temperature of the melt.

The fiber 24 was cut into lengths of approximately ¾ of an inch and placed upon a first layer 32 of a label. A second layer 30 was placed over the fiber 24, in registration with the first layer, and with adhesive therebetween so as to form a label 28. The fibers 24 may be placed in aligned spaced relationship, as shown in FIG.

Figure 6:
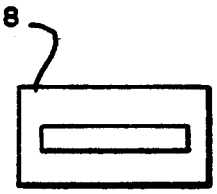
FIG. 6 is a plan view of a label including a strip of amorphous ferromagnetic alloy within a label.

4, approximately one mm apart, or they can be located within the label 28 in random fashion. It has been found that 3 or more fibers placed in alignment would be sufficient for the marker to be sensed in an interrogation zone; whereas, when the fibers when placed in random fashion, 5 or more fibers were sufficient. Placing the fibers 24 in random fashion, overlapping one another is unique in the field. Previous markers required multiple elements be aligned with and/or sequential from one another. Other orientations are possible. One or more fibers coiled, bent or curved can also provide acceptable responses for detection. It was found that the minimum total weight of fibers 24 that are detectable was approximately 0.2 milligrams. As shown in FIG. 6, an amorphous ferromagnetic ribbon 25 containing niobium as described herein can be used in a marker but the length of the ribbon would be greater than the length of a fiber to be detectable.

In the determination of the performance of an amorphous ferromagnetic marker, perhaps the most critical parameter is the t1/2 which is the measure of how sharp the pulse induced by such marker is in an interrogation zone. More specifically, t1/2 represents in microseconds the time lapse between rising and trailing portions at one half the peak value of the induced signal. A value of t1/2=10 micro seconds or less is considered acceptable. A lower value is desirable because this indicates a sharp, easy to detect peak and hence high harmonic content.

The values of t 1/2 for various niobium-cobalt amorphous ferromagnetic alloy compositions are given in the table below:

TABLE III

| Co | Fe | Nb | Si | B | $t_{\frac{1}{2}}$ at 6 kHz (μsec) | $t_{\frac{1}{2}}$ at 10 kHz (μsec) |
|---|---|---|---|---|---|---|
| 71 | 4 | 5 | 13.5 | 6.5 | 3.5 | 3.3 |
| 71 | 4 | 7 | 10 | 8 | 6.0 | — |
| 71 | 4 | 4.5 | 14 | 6.5 | 4 | — |
| 71 | 4 | 7 | 10 | 8 | 6 | — |

Data taken with a full-scale sweep of 2 Oe field, sample mass between 0.33 mg to 1.0 mg and a length of 6 cm.

Frequency dependence for a representative composition, $Co_{71}Fe_4Nb_{4.5}Si_{14}B_{6.5}$ was found as follows:

TABLE IV

| frequency in kHz | 3 | 6 | 10 | 20 | 40 |
|---|---|---|---|---|---|
| $t_{\frac{1}{2}}$ in μsec | 3.2 | 2.3 | 1.9 | 1.4 | 0.9 |

Thus, what is shown and described is an amorphous ferromagnetic alloy and method of making the same having niobium in various amounts as a constituent thereof.

What is claimed is:

1. An amorphous ferromagnetic alloy containing 2.5 to 15% niobium and less than 12% boron and made by rapid solidification.

2. A marker for use in an electronic article surveillance system, the marker comprising: a marker element for producing a detectable response and including an amorphous ferromagnetic element made from a molten alloy containing 2.5 to 15% niobium, and a carrier for the marker element.

3. The marker of claim 2 wherein said amorphous ferromagnetic marker is a fiber.

4. The marker of claim 2 wherein said amorphous ferromagnetic marker is a ribbon.

5. The marker as defined in claim 2 wherein said ferromagnetic fiber is produced from said molten alloy by rapid solidification techniques.

6. A marker for use in an electronic article surveillance system, the marker comprising: an amorphous ferromagnetic element having 2.5 to 15% niobium, a length less than 15 millimeters and cross-sectional area of less than $6\times10^{-3}$ square millimeters.

7. The marker of claim 6 wherein said amorphous ferromagnetic element is a fiber.

8. The marker of claim 6 wherein said amorphous ferromagnetic element is a ribbon.

9. A marker as defined in claim 6, wherein the marker element has a t1/2 value of less than 10 microseconds at 6 kHz.

10. A web of markers for use in an electronic article surveillance system, the web comprising: a web of labels and a plurality of amorphous, ferromagnetic marker elements having a composition containing 2.5 to 15% niobium and supported by each of the labels for producing a detectable response.

11. A method of making a marker for use in an electronic article surveillance system, comprising the steps of: rapidly solidifying an amorphous, ferromagnetic element having a composition containing 2.5 to 15% niobium from a pool of molten alloy, and incorporating the resulting element within a support.

12. The method as defined in claim 11, wherein the incorporating step includes incorporating the element into fabric.

13. The method as defined in claim 11, wherein the incorporating step includes adding the element into a paper-making slurry, and converting the slurry into paper.

14. The method as defined in claim 11, further comprising the step of cutting the element into a plurality of pieces, and wherein the incorporating step includes mounting the pieces on a plurality of support members.

15. The method as defined in claim 14, wherein the cutting step includes cutting the element into a plurality of fiber pieces each having a predetermined length.

16. A method of making a web of markers for use in an electronic article surveillance system, comprising the steps of: providing a web of material, orienting amorphous, ferromagnetic elements having a composition containing 2.5 to 15% niobium on the web, and wherein the material is divided into labels each having at least one marker element.

17. A marker for producing a detectable response in an electronic article surveillance system, the marker comprising: a support element, an amorphous, ferromagnetic fiber having a composition containing 2.5 to 15% niobium supported by the support element, the fiber having a cross sectional area of less than $6\times10^{-3}$ square millimeters.

18. A ferromagnetic marker for use in an article surveillance system comprising:

an amorphous ferromagnetic fiber having a composition containing 2.5 to 7.5% niobium and an aspect ratio of greater than 150, said amorphous ferromagnetic fiber being positioned between two dielectric sheets, and said sheets begin joined so as to hold said amorphous ferromagnetic fibers therebetween to form a marker.

19. The ferromagnetic marker of claim 18 wherein said marker has a length of less than one inch.

20. An amorphous ferromagnetic fiber having a composition containing 2.5 to 15% niobium, a nominal diameter of less than 80 microns and a t1/2 of less than 10 microseconds in a driving frequency of 6 $kH_z$ and an amplitude in the order of one Oersted.

21. The fiber of claim 20 wherein said fiber has an aspect ratio greater than 150.

22. The fiber of claim 21 wherein said fiber has a kidney shaped cross section.

23. The fiber of claim 21 wherein said fiber has a generally circular cross section.

24. An amorphous ferromagnetic alloy having a composition comprising:

$$Co_aFe_bNb_cSi_dB_e$$

"a" ranges from 65 to 79%

"b" ranges from 2 to 7%

"c" ranges from 2.5 to 15%

"d" is less than 16% inclusive

"e" is less than 12% inclusive and wherein said ranges are in atomic percent.

25. The amorphous ferromagnetic alloy of claim 24 and

| | |
|---|---|
| $0 \leqq d + e \leqq 14$ | when $0 \leqq d \leqq 4$ |
| $0 \leqq e \leqq 10$ | when $4 \leqq d \leqq 5$ |
| $0 \leqq e \leqq 10$ | when $5 \leqq d \leqq 7$ |
| $e \leqq 12$ and $d + e \geqq 17$ | when $5 \leqq d \leqq 7$ |
| $0 \leqq e \leqq 12$ | when $7 \leqq d \leqq 8$ |
| $0 \leqq d + e \leqq 20$ | when $8 \leqq d \leqq 12$ |
| $0 \leqq e \leqq 8$ | when $12 \leqq d \leqq 15$ |
| $0 \leqq d + e \leqq 23$ | when $15 \leqq d \leqq 18$ |
| $0 \leqq e \leqq 5$ | when $18 \leqq d \leqq 20$ |

* * * * *